US010907431B2

(12) United States Patent
Copold et al.

(10) Patent No.: US 10,907,431 B2
(45) Date of Patent: Feb. 2, 2021

(54) FISHING TOOL RECEIVER WITH LOCKING COLLAR

(71) Applicant: Schlumberger Technology Corporation, Sugar Land, TX (US)

(72) Inventors: Derek Ivan Copold, Sugar Land, TX (US); Barry Albert Lumankun, Cikarang (ID)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 93 days.

(21) Appl. No.: 16/378,157

(22) Filed: Apr. 8, 2019

(65) Prior Publication Data

US 2019/0309592 A1 Oct. 10, 2019

Related U.S. Application Data

(60) Provisional application No. 62/654,997, filed on Apr. 9, 2018, provisional application No. 62/769,173, filed on Nov. 19, 2018.

(51) Int. Cl.

| | |
|---|---|
| ***E21B 31/00*** | (2006.01) |
| ***E21B 31/12*** | (2006.01) |
| ***E21B 17/02*** | (2006.01) |

(52) U.S. Cl.

CPC ..... *E21B 31/00* (2013.01); *E21B 17/023* (2013.01); *E21B 31/007* (2013.01); *E21B 31/12* (2013.01); *E21B 31/125* (2013.01)

(58) Field of Classification Search

CPC ..... E21B 31/00; E21B 31/12; E21B 17/023; E21B 17/02; E21B 31/007; E21B 31/125; F16L 3/10; F16L 3/1222; F16L 3/12

See application file for complete search history.

(56) References Cited

U.S. PATENT DOCUMENTS 4,108,245 A * 8/1978 Babineaux ..... E21B 31/125 166/301
4,697,641 A * 10/1987 White ..... E21B 17/023 166/243
6,032,733 A 3/2000 Ludwig et al.

(Continued)

OTHER PUBLICATIONS

Analog-Cable Reheading Made Simple (after GOI)—http://www.logwell.com/tech/app_notes/Cable_Reheading.PDF (4 pages).

(Continued)

*Primary Examiner* — Michael R Wills, III
(74) *Attorney, Agent, or Firm* — Eileen Pape

(57) ABSTRACT

The present disclosure is directed to a fishing head and a steel boot of a downhole receiver tool. In certain embodiments, the fishing head may include multiple body portions that include a channel to hold a cable of a downhole tool and a recess that is formed at the interface of the body portions. The body portions may be coupled via one or more pins that are fitted into the recess. In certain embodiments, a collar may be positioned on an exterior portion of the body portions of the fishing head to further secure the components. In certain embodiments, the collar may be coupled to the body portions of the fishing head via a biasing member such as a spring pin or other suitable coupling components.

20 Claims, 10 Drawing Sheets

(56) References Cited

U.S. PATENT DOCUMENTS

| | | | | |
|---|---|---|---|---|
| 7,255,165 | B2 * | 8/2007 | Abdo | E21B 17/10 166/241.2 |
| 7,523,786 | B2 * | 4/2009 | Rose | E21B 31/00 166/178 |
| 8,919,436 | B2 * | 12/2014 | Wheater | E21B 17/10 166/241.5 |
| 9,663,999 | B2 * | 5/2017 | Lea-Wilson | E21B 17/06 |
| 2015/0129204 | A1 * | 5/2015 | Smith | E21B 47/09 166/250.01 |
| 2017/0051571 | A1 * | 2/2017 | Drenth | E21B 25/00 |
| 2019/0169976 | A1 * | 6/2019 | Wheater | E21B 17/10 |

OTHER PUBLICATIONS

Core Laboratories_Guardian Global Technologies—http://www.ggtg.net/datasheets/Cable%20Head.pdf (1 page).
Hunting—Electrical Cable Heads—http://www.hunting-intl.com/titan/wireline-hardware-and-accessories/electrical-cable-heads (1 page).
http://www.weatherford.com/en/standard-cable-head, Last known date when the link worked: Sep. 30, 2017.
Wireline Cable Heads—https://www.geoilandgas.com/oilfield/wireline-technology/wireline-cable-heads (2 pages).
http://www.yjoiltools.com/wireline-cable-heads, Last known date when the link worked: Sep. 30, 2017.

* cited by examiner

FISHING TOOL RECEIVER WITH LOCKING COLLAR

CROSS-REFERENCE TO RELATED APPLICATION

This patent application claims priority from and the benefit of U.S. Provisional Application Ser. No. 62/654,997, entitled "Fishing Tool with Locking Collar," filed Apr. 9, 2018, and U.S. Provisional Application Ser. No. 62/769,173, entitled "Fishing Tool Receiver with Locking Collar," filed Nov. 19, 2018, which are hereby incorporated by reference in their entirety for all purposes.

BACKGROUND

The present disclosure relates to a downhole fishing tool receiver having a fishing neck or a boot, wherein the downhole fishing tool received includes a locking collar that may retain stability despite impacts or vibrations downhole.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A wellbore drilled into a geological formation may be targeted to produce oil and/or gas from only certain zones of the geological formation. After or during certain wellbore operations, it is desirable to get data from the wellbore to get more information about the formation in the wellbore using E-line/wireline or slickline. When a set of tools is conveyed using E-line/wireline or slickline to gather data in the wellbore, there is a potential risk for the tools to get stuck (e.g., in a wellbore in a process to retrieve a set of tools or any equipment that may have fallen in to the wellbore or are left over inside the wellbore because of any uncertain reasons known as "fishing"). Generally, fishing is the application of tools, equipment, and techniques for the removal of the previously mentioned items. Fishing in a wellbore may be a relatively high-impact or high-vibration endeavor. Under these relatively high-impact or high-vibration conditions, for example, bolts used to fasten a fishing neck or boot of the fishing tool receiver to a wireline cable could loosen or detach. This could cause the fishing neck or boot of the fishing tool receiver to weaken or detach while an item is fished out of the wellbore.

SUMMARY

A summary of certain embodiments disclosed herein is set forth below. It should be understood that these aspects are presented merely to provide the reader with a brief summary of these certain embodiments and that these aspects are not intended to limit the scope of the present disclosure. Indeed, the present disclosure may encompass a variety of aspects that may not be set forth below.

Embodiments of the present disclosure relate to a system that includes a fishing neck body having a first body portion and a second body portion, wherein the first body portion and the second body portion are configured to be coupled together along an interface that extends from an upstream end of the fishing neck body to a downstream end of the fishing neck body and terminates with an opening configured to receive a cable, and wherein the fishing neck body has a first recess and a second recess disposed along an interior wall of a first axial portion of the fishing neck body. Further, the system includes one or more pins disposed within the first recess of the first body portion and the second recess of the second body portion to couple the first body portion to the second body portion. Even further, the system has a collar configured to circumferentially surround a second axial portion of the fishing neck body, wherein the collar has a third recess configured to align with a corresponding groove on an exterior surface of the fishing neck body. Further still, the system includes a biasing member configured to be disposed within the third recess and in contact with the corresponding groove to couple the collar to the fishing neck body and prevent the collar from axially translating with respect to the fishing neck body.

Another embodiment of the present disclosure relates to a fishing tool receiver assembly that includes a fishing extension, a cable, and a body of a fishing neck or a steel boot. The body has a first body portion and a second body portion, wherein the first body portion and the second body portion are configured to be coupled along an interface that extends from an upstream end of the body to a downstream end of the body and terminates with an opening configured to receive the cable, wherein the first body portion has a first recess and the second body portion has a second recess, and wherein each of the first and second recesses are disposed along an interior wall of a first axial portion of the body. The body also has one or more pins configured to be disposed within the first recess of the first body and the second recess of the second body to couple the first body portion to the second body portion. Further, the body has a collar configured to circumferentially surround a second axial portion of the body, wherein the collar has a recess configured to align with a corresponding groove on an exterior surface of the body. Further still, the body has a biasing member configured to be disposed within the recess and in contact with the corresponding groove to couple the collar to the body and prevent the collar from axially translating with respect to the body.

Another embodiment of the present disclosure relates to a method of assembling a fishing neck or steel boot around a cable. The method includes positioning a first body portion and a second body portion around the cable, wherein both the first body portion and the second body portions has a first recess and a second recess, respectively, formed at an interface between the first body portion and the second body portion, and wherein the first body portion and second body portion has an indentation that circumferentially surrounds an exterior surface of the first body portion and the second body portion. The method also includes coupling the first body portion to the second body portion by disposing pins within the first recess of the first body portion and the second recess of the second body portion. Then, the method includes positioning a collar circumferentially around an axial portion of the first body portion and the second body portion, wherein the collar has a collar recess. Further still, the method includes aligning a biasing member with the collar recess and the indentation to couple the first body portion and the second body portion to the collar.

Various refinements of the features noted above may be undertaken in relation to various aspects of the present disclosure. Further features may also be incorporated in these various aspects as well. These refinements and additional features may exist individually or in any combination. For instance, various features described herein in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of the present disclosure may be better understood upon reading the following detailed description and upon reference to the drawings in which.

DETAILED DESCRIPTION

Figure 1:
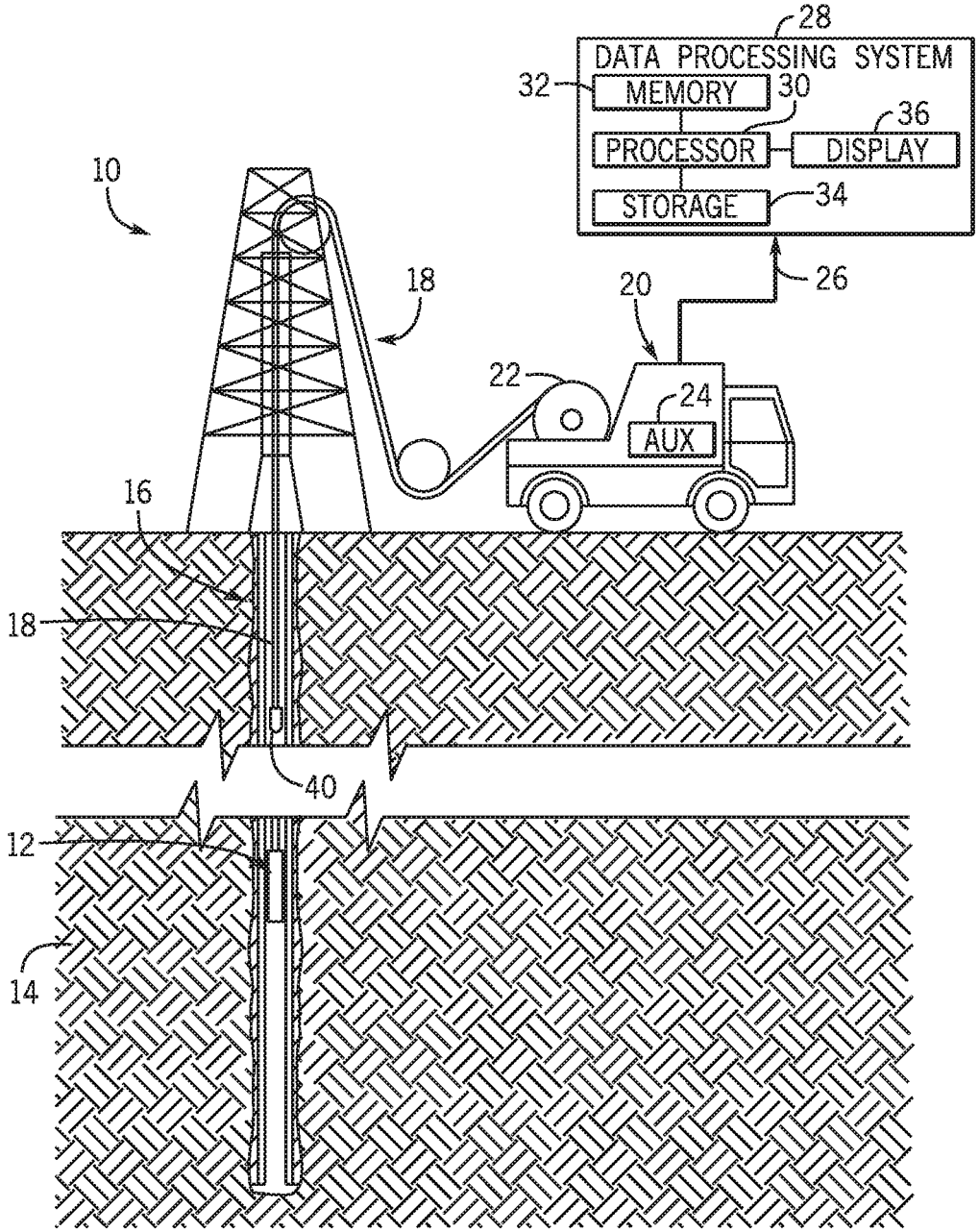
FIG. 1 is a schematic diagram of a system for fishing operations within a well, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of the present disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

During well operations, a set of tools or any equipment that may have fallen into the wellbore or are left behind, which may significantly impede further operations. As such, the debris and/or equipment should be "fished" out of the well so that normal well operations may be carried out. Fishing techniques encompass such techniques for removing these items from wells. In general, fishing techniques involve attaching a fishing tool receiver to a downhole tool, usually along a cable, and lowering the fishing tool receiver into the well for removal of the items. Certain fishing tool receiver assemblies or logging tool assemblies include a fishing neck (e.g., stinger) or a boot (e.g., steel boot), which may surround an outer diameter of a wireline cable. The fishing tool receiver may have a shape or profile for a specific operation, such as retrieving equipment from the well.

For example, certain fishing necks and/or boots may include a split clamping design (e.g., having two portions of a fishing tool receiver that are split during assembly) disposed around the wireline cable. In a split clamp design, the two halves may be coupled via fasteners such as threaded screws. In operation, the fishing tool receiver may experience mechanical forces (e.g., shock or vibration) that may result in damage or disassembly of the fishing tool receiver (e.g., unthreading of the screws). In addition, supplemental restraints, such as a retaining ring, tend to lack the strength to prevent the pieces from falling apart as well.

As such, fishing tool receivers that include such fishing necks or boots may be relatively difficult to assemble and/or made require maintenance after repeated use due to mechanical stresses experienced by the fishing tool receiver during operation. The present disclosure is directed to fishing tool receivers that facilitate easier assembly and a reduced likelihood of becoming dismantled during operation. For example, in certain embodiments, rather than having multiple fasteners that require a relatively time-consuming assembly, the fishing tool receivers described herein may include a threaded ring in combination with multiple dowel pins. Additionally, in certain embodiments, the fishing tool receivers described herein may include a biasing member (e.g., spring pin) installed into a recess of the threaded ring and aligning with a groove on an outer surface of the fishing tool receiver to prevent the threaded ring from coming off (e.g., via translating) the fishing tool receiver.

With the foregoing in mind, FIG. 1 illustrates a well-logging system 10 that may employ the fishing tool systems and methods of the present disclosure. The well-logging system 10 may be used to convey a downhole tool 12 through a geological formation 14 via a wellbore 16 (also sometimes referred to as a borehole). In the illustrated well-logging system 10, the downhole tool 12 may be conveyed via a logging winch system 20. Although the logging winch system 20 is schematically shown in FIG. 1 as a mobile logging winch system carried by a truck, in other embodiments, the logging winch system 20 may be substantially fixed (e.g., a long-term installation that is substantially permanent or modular. It should be noted that, although illustrated in FIG. 1 as being a well-logging system 10, the fishing tool techniques described herein may be employed in other types of well systems where certain items (e.g., debris, the downhole tool 12 itself, and so forth) have become stuck within a wellbore 16.

In addition, although the downhole tool 12 is described herein as a wireline downhole tool, it should be appreciated that any suitable conveyance may be used. For example, the downhole tool 12 may instead be conveyed as a logging-while-drilling (LWD) tool as part of a bottom hole assembly (BHA) of a drill string, conveyed on a slickline or via coiled tubing, and so forth. For the purposes of the present disclosure, the downhole tool 12 may be any suitable measurement tool that uses electrical sensors to obtain high-resolution measurements of the wellbore 16 wall.

As described herein, certain items (e.g., debris, the downhole tool 12 itself, and so forth) may become stuck within the wellbore 16 and may be extracted. As such, a fishing tool receiver 40 (i.e., fishing head) may be conveyed on a wireline cable 18 to extract such items from the wellbore 16. Any suitable cable 18 for well logging or fishing operations may be used. In certain embodiments, the cable 18 may be spooled and unspooled on a drum 22 and an auxiliary power source 24 may provide energy to the logging winch system 20 and/or the downhole tool 12.

Additionally, the embodiment illustrated in FIG. 1 includes a data processing system 28. In certain embodiments, the data processing system 28 may be any electronic data processing system that can be used to carry out the systems and methods of the present disclosure, such as control of the logging winch system 22. For example, in certain embodiments, the data processing system 28 may include a processor 30, which may execute instructions stored in memory 32 and/or storage 34. As such, the memory 32 and/or the storage 34 of the data processing system 28 may be any suitable article of manufacture that can store the instructions. In certain embodiments, the memory 32 and/or the storage 34 may be ROM memory, random-access memory (RAM), flash memory, an optical storage medium, or a hard disk drive, to name but a few examples. In certain embodiments, a display 36, which may be any suitable electronic display, may display images generated by the processor 30. In certain embodiments, the data processing system 28 may be a local component of the logging winch system 20, a remote device that analyzes data from the logging winch system 20, or may be partly local and partly remote. In certain embodiments, the data processing system 28 may be a mobile computing device (e.g., tablet, smartphone, laptop, and so forth) or a server remote from the logging winch system 20.

Figure 2:
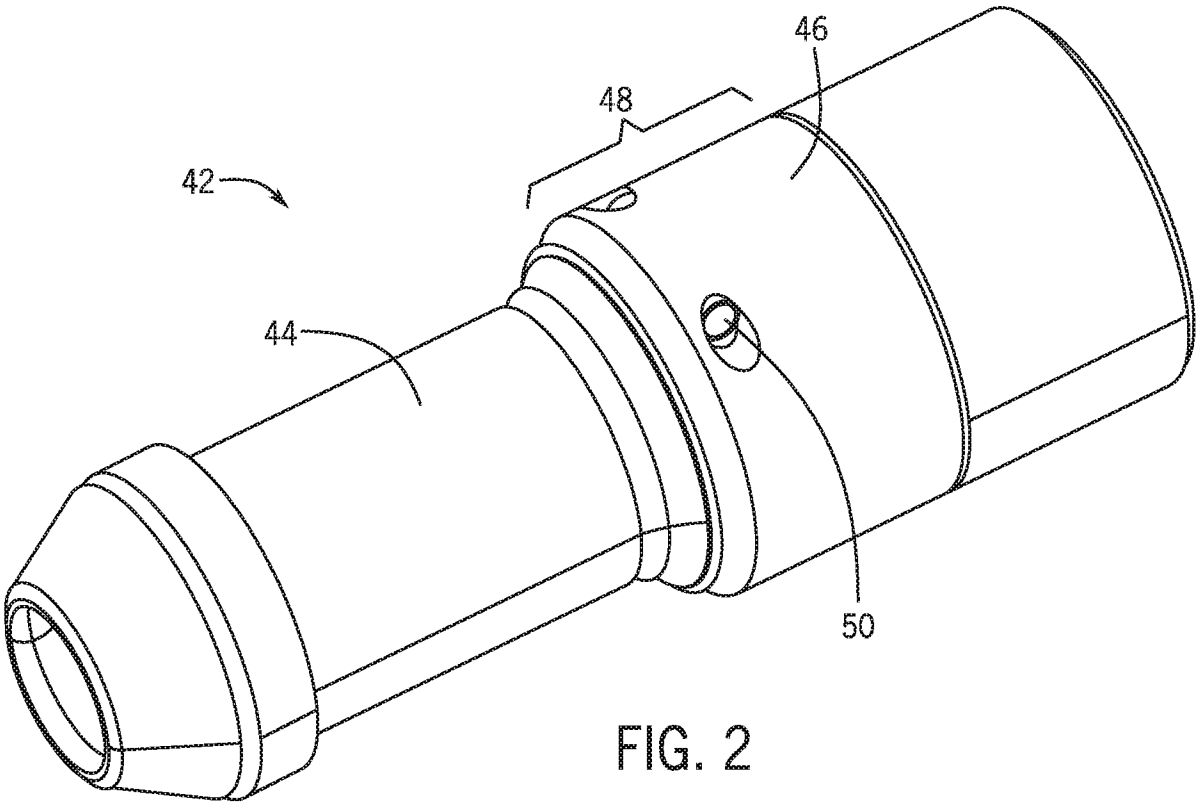
FIG. 2 is a perspective view of a body and a collar of a fishing neck used in fishing operations, in accordance with an embodiment of the present disclosure.

FIG. 2 is a perspective view of a fishing neck 42 that may be assembled with other components to form a fishing tool receiver 40, in accordance with an embodiment of the present disclosure. The fishing neck 42 includes a body 44 and a collar 46 that is coupled along an axial portion 48 of the body 44 of the fishing neck 42. As illustrated, in certain embodiments, the collar 46 includes a biasing member 50, such as a spring pin, which may prevent the collar 46 from axially translating off of the body 44. In certain embodiments, the collar 46 may be a threaded ring that mates with a corresponding exterior of the body 44 along the portion 48 of the body 44, so as to further secure the axial positioning of the collar 46 with respect to the body 44. During assembly, the fishing neck 42 may be disposed circumferentially around, and conveyed downhole by, the cable 18 illustrated in FIG. 1.

Figure 3:
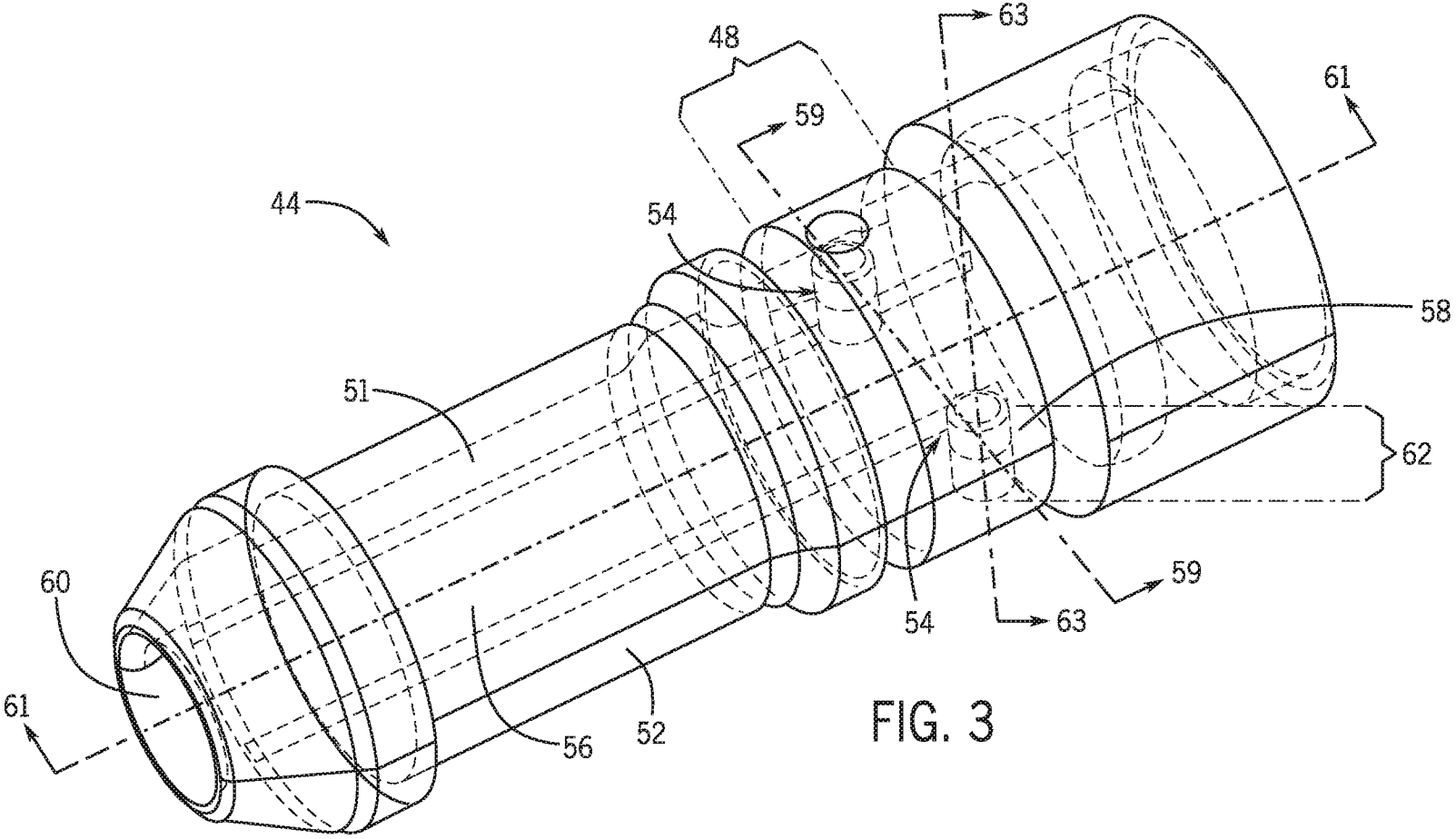
FIG. 3 is a transparent perspective view of a body of a fishing neck, in accordance with an embodiment of the present disclosure.

In certain embodiments, the body 44 of the fishing neck 42 may be a multi-piece component. As such, the multiple pieces of the body 44 of the fishing neck 42 may include suitable coupling components so that the body 44 may be assembled onto the cable 18. FIG. 3 is a transparent perspective view of the fishing neck 42 without the collar 46 to illustrate coupling between body portions 51 and 52 (i.e., the multiple pieces) of the body 44, in accordance with an embodiment of the present disclosure. As illustrated, in certain embodiments, the body portions 51 and 52 may be substantially similar halves configured to couple together around the cable 18 to form the body 44 of the fishing neck 42. In the illustrated embodiment of the body 44 of the fishing neck 42, the body portions 51 and 52 are coupled together by two pins 54 that are disposed on opposing sides of an interior channel 56, which may receive the cable 18, thereby coupling the fishing tool receiver 40 to the cable 18 as described herein.

In certain embodiments, the two pins 54 are disposed within an interior 58 of the body portions 51 and 52 and along the axial portion 48 (e.g., the portion axially along the body 44 to which the collar 46 is coupled). By disposing the pins 54 entirely within the interior 58, rather than partially within the interior 58 (e.g., if an end of the pin terminated on an exterior surface 73, as shown in FIG. 3, of the body 44), it is presently recognized that the pins 54 may resist any shearing forces that the fishing neck 42 may experience during operation. The coupling between the body portions 51 and 52, described above, may be referred to herein as pin and interior body coupling 62. While FIG. 3 shows that the pins 54 are disposed along the axial portion 48 of the body 44, which would be overlapped by the collar 46 (e.g., overlapping along the longitudinal axis that includes the inner channel 56) when assembled, it should be appreciated that, in other embodiments, the pins 54 may be disposed further axially upstream (e.g., towards the opening 60 of the interior channel 56 of the body 44) or further away from the opening 60 (e.g., axially downstream) with respect to the axial portion 48 of the body 44. To facilitate further discussion, FIG. 3 shows three axes 59, 61, and 63, which show the direction of the cross sections shown in FIGS. 4, 5, and 7, respectively.

Figure 4:
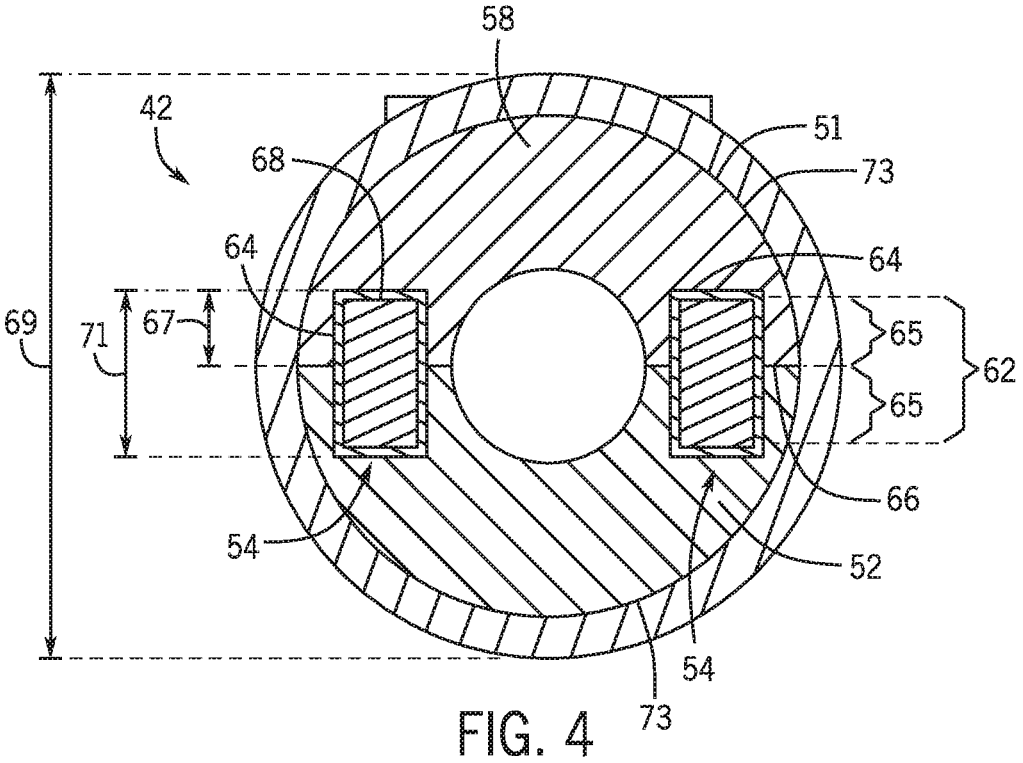
FIG. 4 is a schematic view of a cross section of two body portions of a fishing neck that are coupled together with pins, in accordance with an embodiment of the present disclosure.

FIG. 4 is a cross section of the body 44 of the fishing neck 42 to illustrate the pin and interior body coupling 62, in accordance with an embodiment of the present disclosure. As illustrated, in certain embodiments, the pins 54 are disposed within corresponding recesses 64 (e.g., indicated by the boxes), and the recesses 64 are disposed along an interface 66 between the body portion 51 and the body portion 52. In other words, each of the body portions 51 and 52 may include corresponding recesses that, when the body portions 51 and 52 are assembled together, form the recesses 64 of the integrated body 44. Moreover, in certain embodiments, the recesses 64 extend into the interior 58 of each body portion 51 and 52. As such, when the pins 54 are disposed within each respective recess 64, the pins 54 directly contact both of the body portions 51 and 52. As illustrated, in certain embodiments, the pins 54 extend into a portion 65 of the interior 58 of each body portion 51 and 52. In certain embodiments, the portion 65 may be approximately 25% of a length 67 of each body portion 51, 52 (i.e., as measured from a central longitudinal axis of the body 44 to a circumference of the respective body portion 51, 52). However, in other embodiments the portion 65 may extend a suitable fraction of the into each interior 58, or more specifically, the length 67 of each portion 65 may be 5%, 10%, 15%, or 20% of the diameter 69 of the fishing neck 42 along the portion 48. For example, in some embodiments, the lengths 71 of each pin 54 may be 25% of the diameter 69 of the fishing neck. As such, the pins 54 may not extend to the exterior surface 73 of the body portions 51 and 52. As illustrated, the pins 54 extend perpendicularly from the interface 66 and extend the portion 65 extends the same distance into the interior 58 of the body portions 51 and 52. In certain embodiments, the pins 54 and/or the body portions 51 and 52 may include threading along the interface 68 between the pins 54 and the body portions 51 and 52.

Figure 5:
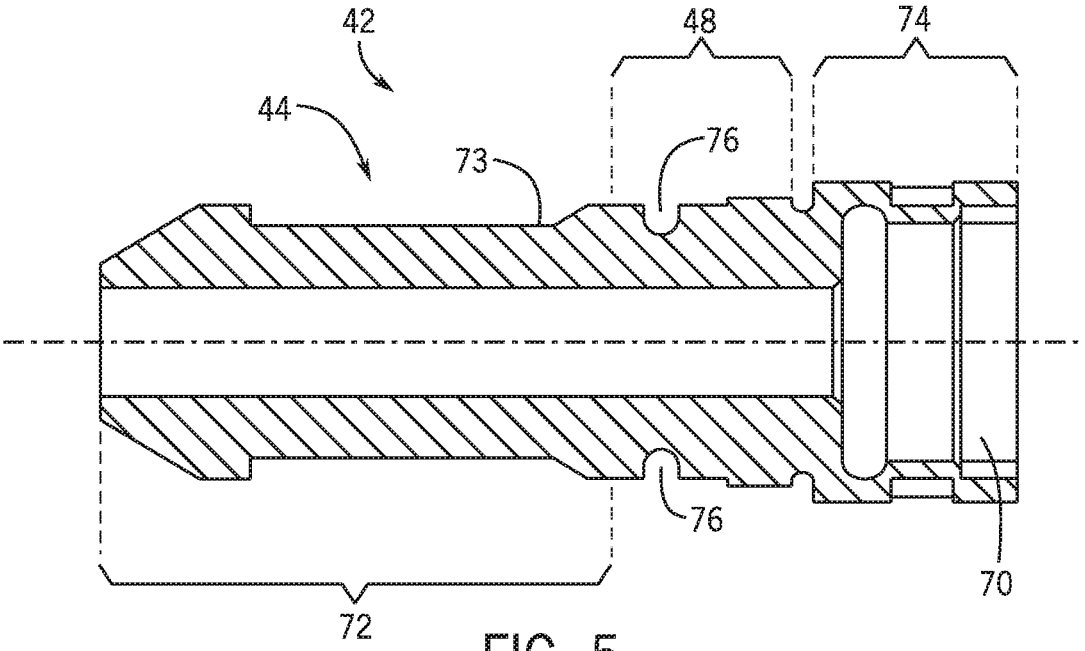
FIG. 5 is a cross section of a fishing neck without a collar, in accordance with an embodiment of the present disclosure.

FIG. 5 shows a cross section of the body 44 of the fishing neck 42, in accordance with an embodiment of the present disclosure. The illustrated embodiment of the body 44 of the fishing neck 42 generally includes three axial portions 72, 48, and 74. As described herein, an assembled fishing neck receiver 40 may include axial portions 72, 48, and 74 having any suitable shapes for use as a fishing tool. In particular, the shape of the axial portion 72 (e.g., first axial portion) may vary depending on the type of downhole operation. However, it should be appreciated that the techniques of the present disclosure may be used for various shapes such as fishing necks and/or steel boots. A collar (not shown) may generally couple to the axial portion 48 (e.g., second axial portion) of the body 44 of the fishing neck 42 as described herein. In certain embodiments, the body 44 of the fishing neck 42 may include an indentation 76 on an exterior surface 73 of the body 44 that may facilitate coupling between the body 44 and the collar 46, as described herein. In certain embodiments, the indentation 76 may circumferentially surround the body 44, or surround both the body portions 51 and 52 continuously (e.g., generally not interrupted). The axial portion 74 (e.g., third axial portion) may be coupled to the fishing extension (e.g., element 94 shown in FIG. 10) by any suitable means such as clamping, a threaded connection, or snapped on. The interior 70 within the third axial portion 74 may be shaped to fit the fishing extension.

Figure 6:
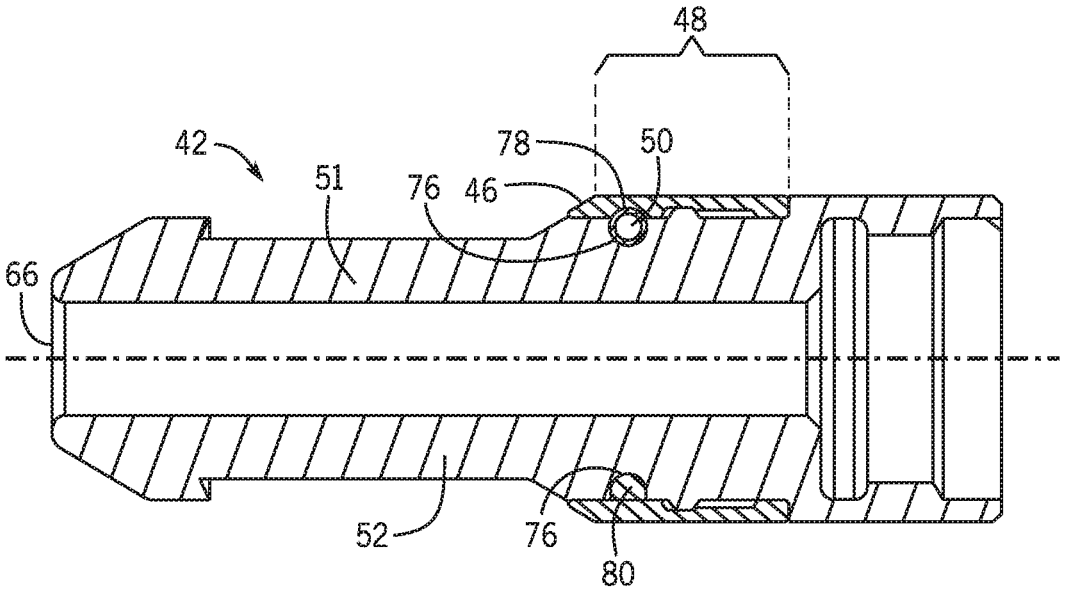
FIG. 6 is a cross section of a fishing neck with a collar, in accordance with an embodiment of the present disclosure.

With FIG. 5 in mind, FIG. 6 is a cross section of the fishing neck 42 with the collar 46 coupled to the body 44, in accordance with an embodiment of the present disclosure. In certain embodiments, the collar 46 may partially or completely circumferentially surround the body 44 (e.g., both the body portion 51 and body portion 52 together) of the fishing neck 42. As illustrated, in certain embodiments, the biasing member 50 may be disposed within the indentation 76 and partially extend into an interior recess 78 of the collar 46. In certain embodiments, the biasing member 50 may form a friction fit, interference fit, or press fit such that biasing member 50 maintains its position within the indentation 76 of the body 44 and the recess 78 of the collar 46 and, thus, facilitates the coupling between the collar 46 and the body 44. As illustrated, in certain embodiments, the biasing member 50 may be directly coupled to the recess 78 of the collar 46 and one of the body portions 51 and 52 (e.g., the body portion 51, as illustrated in FIG. 6). However, in certain embodiments, the biasing member 50 may directly contact both body portions 51 and 52. As also illustrated, in certain embodiments, the collar 46 may include a projection 80 that projects into the indentation 76 of one of the body portions 51 and 52 (e.g., the body portion 52, as illustrated in FIG. 6). This may further maintain coupling between the collar 46 and the body 44.

Figure 7:
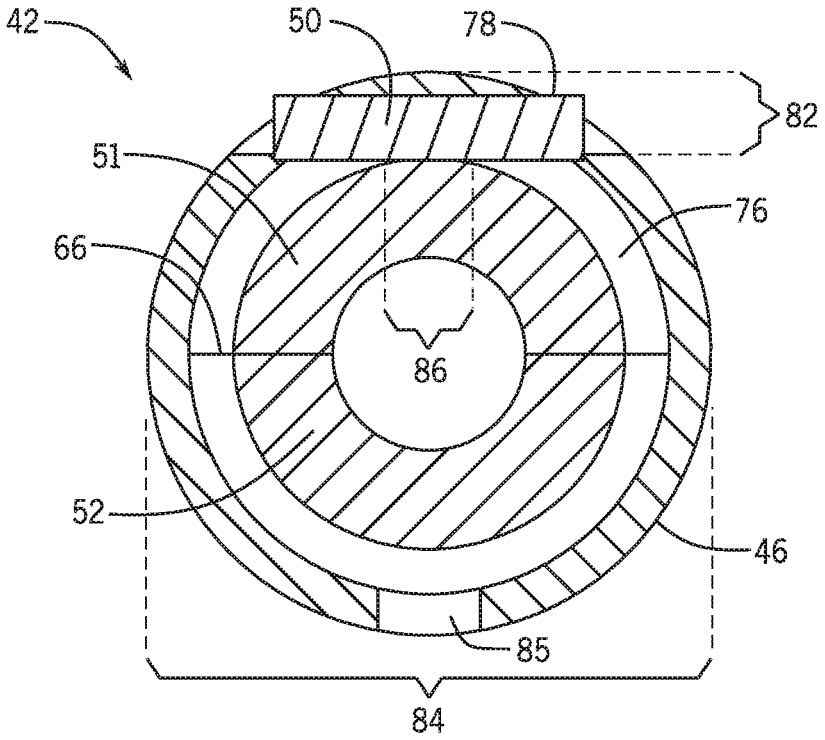
FIG. 7 is a cross section of a fishing neck with a collar and a biasing member, in accordance with an embodiment of the present disclosure.

FIG. 7 is a cross section of the body 44 of the fishing neck 42 with the collar 46 to illustrate the biasing member 50 and a fishing neck coupling 82 (e.g., the coupling between the biasing member 50 with the recess 78 of the collar 46 and the indentation 76 of the body 44), in accordance with an embodiment of the present disclosure. As illustrated, in certain embodiments, the biasing member 50 may be disposed within both the recess 78 of the collar 46 and a portion (e.g., within the region 84) of the indentation 76 of the body 44. Further, in certain embodiments, the biasing member 50 does not circumferentially surround the body 44 along the indentation 76. Rather, the biasing member 50 is in tangential contact with the indentation 76 along a portion 86 of the body portion 51. In certain embodiments, the portion 86 may directly overlap with the interface 66 between the body portion 51 and body portion 52. The collar 46 may also include a hole 85 that is accessible by a tool for ease of assembly or modification (e.g., a wrench to apply torque to the collar).

Figure 8:
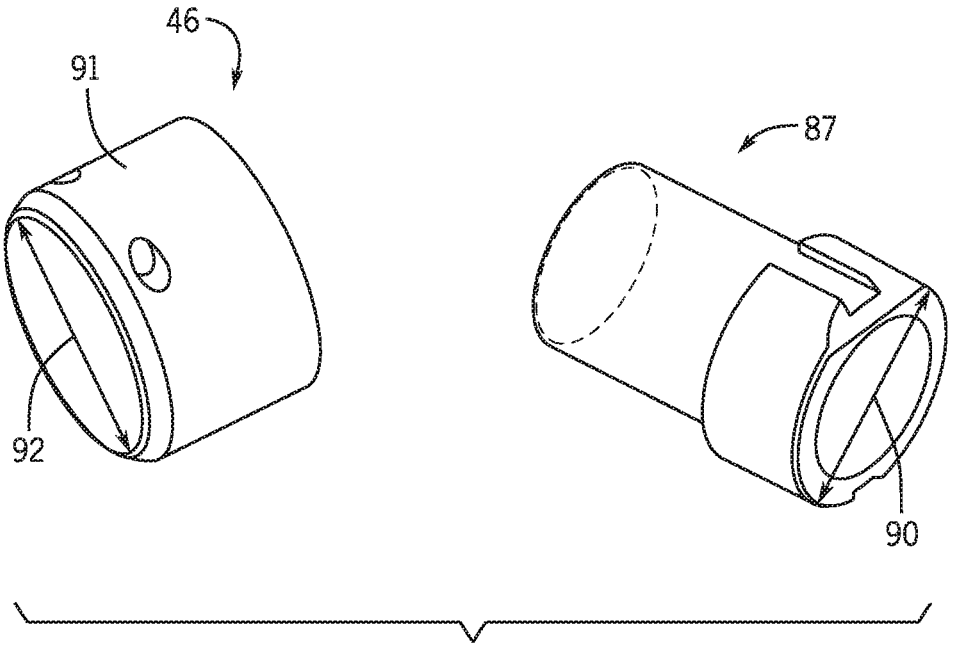
FIG. 8 is a partial perspective view of an axial portion of fishing neck body and a collar of a fishing neck, in accordance with an embodiment of the present disclosure.

FIG. 8 is a partial perspective view of the collar 46 and an outer cone part 87 (e.g., from a rope socket cone assembly that makes up the termination of a wireline cable assembly). As illustrated, in certain embodiments, an outer diameter 90 of outer cone part 87 is smaller than an inner diameter 92 of the collar 46 to facilitate positioning of the collar 46 over the outer cone part 87. As such, the cable termination may not have to be rebuilt during assembly, which reduces the assembly time. In addition, in certain embodiments, an exterior surface 91 of the collar 46 may be knurled to enable a better grip by an operator during assembly of the fishing neck 42.

Figure 9:
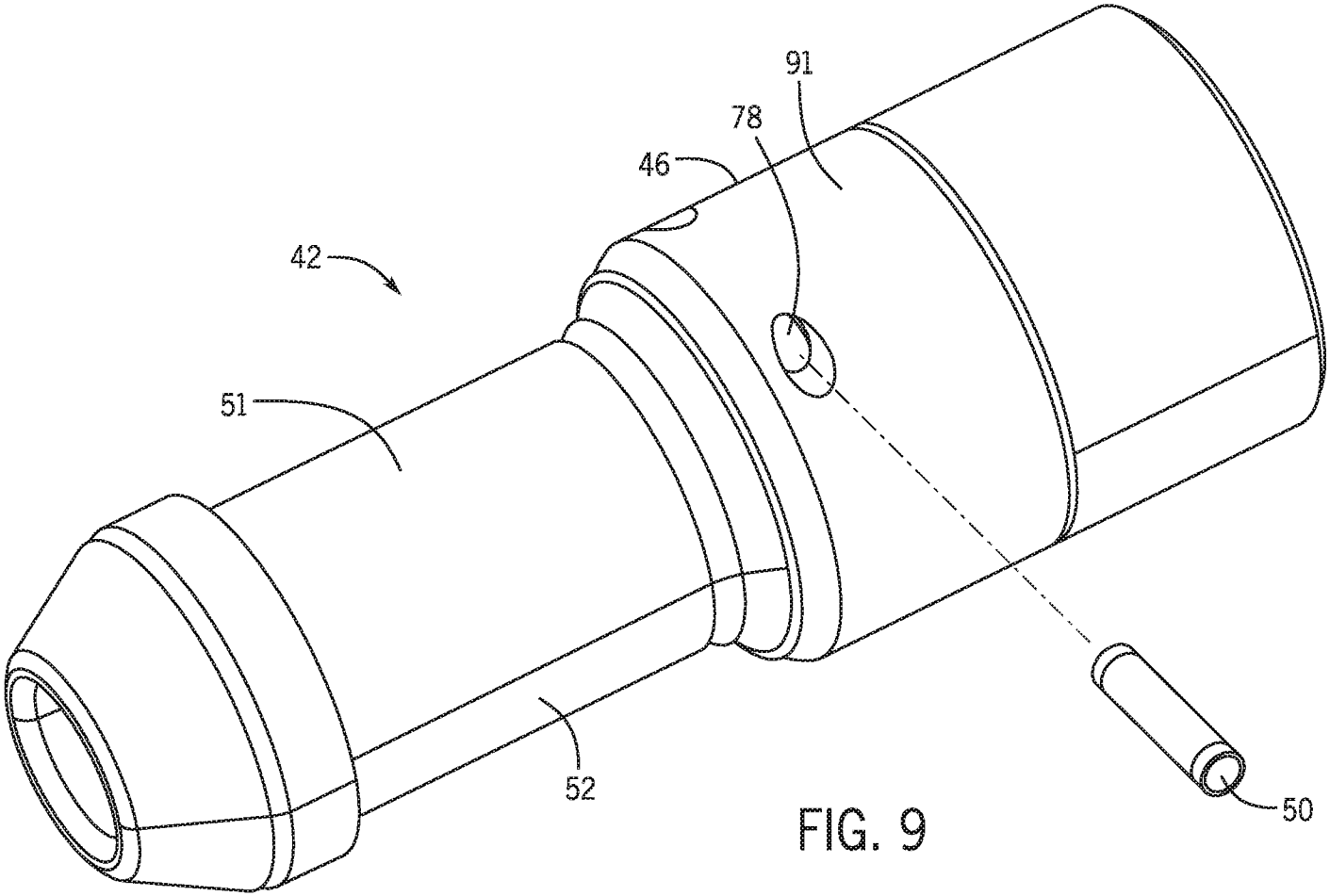
FIG. 9 is a perspective view of fishing neck showing the biasing member, in accordance with an embodiment of the present disclosure.

FIG. 9 is a perspective view of the fishing neck 42 with an exploded view of the biasing member 50, in accordance with an embodiment of the present disclosure. As illustrated, in certain embodiments, the biasing member 50 may be positioned (e.g., slid) into the recess 78 of the collar 46 and, thus, also be positioned in an indentation 76 of the body 44 of the fishing neck 42 (e.g., as shown in FIG. 6).

Figure 10:
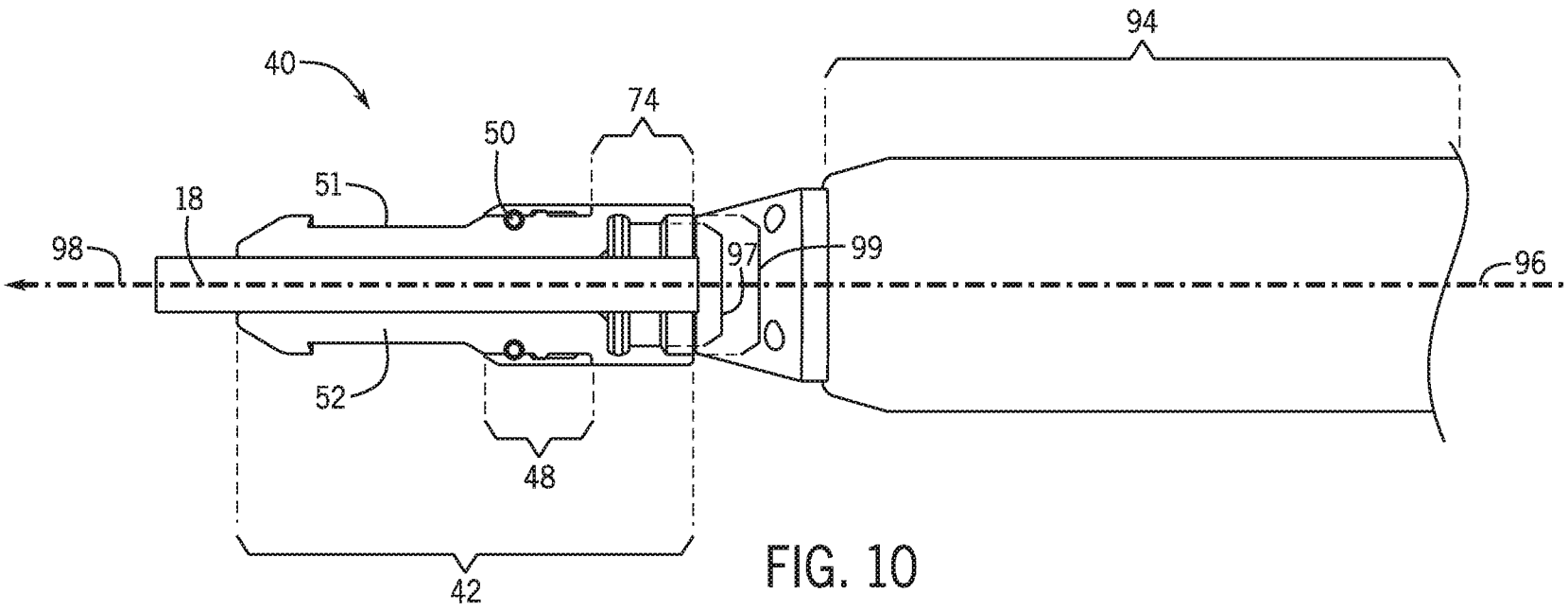
FIG. 10 is a cross section of a fishing tool receiver, in accordance with an embodiment of the present disclosure.

FIG. 10 is a cross section of a fishing tool receiver 40 attached to the wireline cable 18, in accordance with an embodiment of the present disclosure. The fishing tool receiver 40 includes the fishing neck 42 that may be coupled to a fishing extension 94 (e.g., at the axial portion 74 of the body 44 of the fishing neck 42). The fishing extension may include the outer cone part 87. As described herein, the fishing neck 42 may be split into portions that each circumferentially surround a portion of the wireline cable 18. As illustrated, the body 44 of the fishing neck 42 is split into two substantially similar body portions 51 and 52, along the interface 66. However, in other embodiments, the fishing neck body 44 may include two portions that circumferentially surround the wireline cable 18 in any portions (e.g., one portion may surround a third of the circumference of the wireline cable 18, while another portion may surround two-thirds of the circumference of the wireline cable 18).

In certain embodiments, the two body portions 51 and 52 of the fishing neck 42 are coupled together by the collar 46. As described herein, in certain embodiments, the collar 46 circumferentially surrounds the body portion 51 and 52 along the axial portion 48 of the body 44 of the fishing neck 42. As shown, the axial portion 48 is closer to a downstream end 96 of the borehole 16 (e.g., opposite the wireline cable 18). It should be appreciated that the collar 46 may be disposed in any suitable position such that it maintains the connection between the body portions 51 and 52. The wireline cable 18 extends from the opening 60 at the upstream end 98 of the fishing neck 42. The positioning of the collar 46 along the axial portion 48 on the exterior surface 73 of the body portions 51 and 52 of the fishing neck 42 is maintained by the biasing member 50.

Additionally, in certain embodiments, an outer diameter 97 of the fishing extension 94 may be smaller than an outer diameter 99 of the body 44 of the fishing neck 42 at a point of connection between the fishing neck 42 and the fishing extension 94 (e.g., adjacent the axial portion 74 of the body 44 of the fishing neck 42). It is presently recognized that this may ease assembly as there is no need to rebuild cable termination. In other words, the body 44 of the fishing neck 42 may be specifically configured to fit the fishing extension 94.

Figure 11:
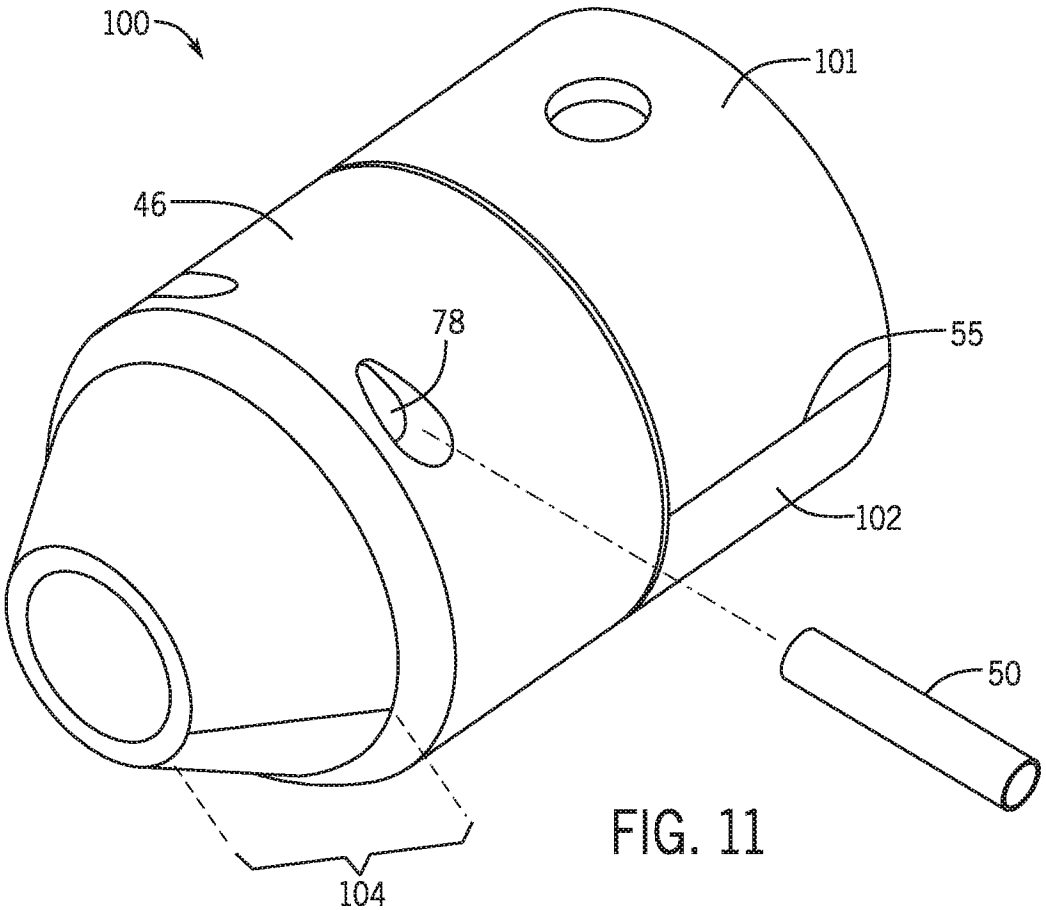
FIG. 11 is a perspective view of a steel boot, in accordance with an embodiment of the present disclosure.

In certain embodiments, the fishing tool receiver 40 may have either a fishing neck profile or a steel boot profile. In general, the profile of the fishing tool receiver 40 may be determined based on the desired downhole operation. FIG. 11 is a perspective view of a steel boot 100 with an exploded view of the biasing member 50, in accordance with an embodiment of the present disclosure. As illustrated, in certain embodiments, the steel boot 100 includes the collar 46 that is coupled to body portions 101 and 102, which are separated by an interface 66. The body portions 101 and 102 may be coupled via the pin and interior body coupling 62, as described herein (e.g., with respect to FIG. 3). In certain embodiments, the biasing member 50 may be positioned into the recess 78 of the collar 46 and coupled with the body portions 101 and/or 102 via the biasing member 50 and a coupling substantially similar to the fishing neck coupling 82 described herein with respect to FIG. 7. That is, the body portions 101 and 102 may include an indentation 76 that circumferentially surrounds the two portions 101 and 102 and facilitate the positioning of the biasing member 50.

Figure 12:
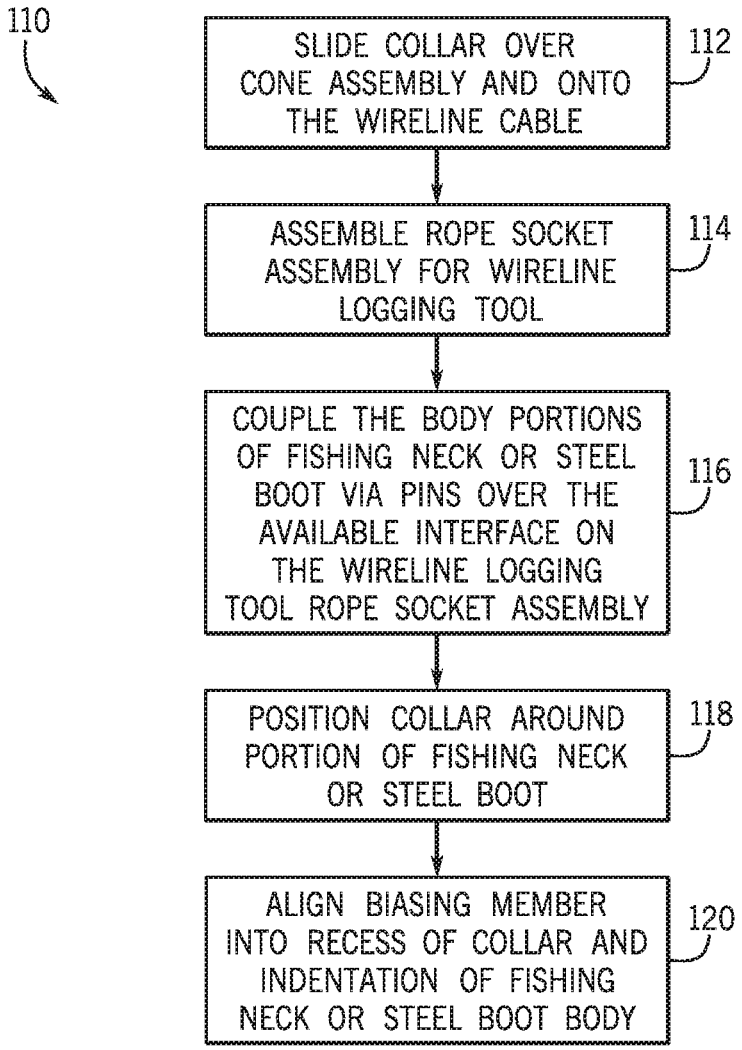
FIG. 12 is a flow diagram for a method of assembling a fishing neck, in accordance with an embodiment of the present disclosure.

FIG. 12 is a flow diagram of one embodiment of a method 110 for assembling the fishing neck 42 and/or the steel boot 100, in accordance with an embodiment of the present disclosure. While the method 110 is described with respect to the fishing neck 42, it should be appreciated that the method 110 may also be applied to assembling the steel boot 100. In block 112, the collar 46 is slid over the cone assembly, which includes the outer cone part 87 (shown in FIG. 8), and onto the wireline cable assembly. As noted above, the diameter 92 of the collar is greater than the outer diameter 90 of the outer cone part and, thus, facilitates assembly may prevent additional steps that may lengthen the assembly process. Then, in block 114, the rope socket assembly is assembled as it should be appreciated by one of ordinary skill in the art. In block 116, the body portions 51 and 52 are coupled via pins 54 over an available interface on the wire logging tool rope socket assembly. That is, the pins 54 are aligned within corresponding recesses 76 of the body portions 51 and/or 52 of the fishing neck 42. As described herein, in certain embodiments, the body 44 may include two portions (e.g., the body portions 51 and 52). The pins 54 facilitate the coupling (e.g., via a friction fit) between the two the body portions 51 and/or 52 of the fishing neck 42 along the interface 66 between the body portions 51 and 52. In block 118, the collar 46 is positioned around the exterior surface 73 of the fishing neck 42 or the steel boot 100 along the axial portion 48 of the body 44 of the fishing neck 42. In some embodiments, this may include sliding the collar 46 back up the cable (e.g., over the outer cone part 87) and then onto the body 44 (e.g., including the portions 51 and 52) of the fishing neck 42. In certain embodiments, the collar 46 may be threaded so that it maintains its positioning along the axial portion 48 of the body 44 of the fishing neck 42. Moreover, as described herein, the outer diameter 90 of the outer cone part 87 may be smaller than the inner diameter 92 of the collar 46, to facilitate pre-positioning and coupling of the collar 46 with the body 44 of the fishing neck 42. In certain embodiments, the exterior surface 91 of the collar 46 may be knurled, and may reduce the need for tools (e.g., hex key or wrench) to facilitate coupling. In block 120, the biasing member 50 is positioned within the recess 78 of the collar 46. The recess 78 aligns with the indentation 76 of the body 44 to facilitate coupling between the collar 46 and the body 44, and prevent the collar 46 from axially translating (e.g., moving in the upstream direction). That is, the positioning of biasing member 50 within the recess 78 and the indentation 76 maintains (e.g., substantially locks in place) the connection between the collar 46 and the body 44 of the fishing neck 42.

As such, the present disclosure is generally directed to fishing operations. More specifically, the present disclosure is directed to components of a fishing head assembly or logging head assembles. For example, the fishing head assembly may employ a fishing head. The fishing head may include components that provide ease of assembly and improved durability. In certain embodiments, the fishing head may include a body having two body portions. The body portions may be coupled by pins that fit inside a recess formed at an interface of the two body portions. Additionally, a collar may be fitted to a portion of an exterior surface of the body portions. In certain embodiments, the collar overlaps with the recesses for the pins. As described herein, these technical effects may make assembly of the fishing head assemblies easier as well as providing improved durability to the components.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of the present disclosure.

The invention claimed is:

1. A system comprising:

a fishing neck body comprising a first body portion and a second body portion, wherein the first body portion and the second body portion are configured to be coupled together along an interface that extends from an upstream end of the fishing neck body to a downstream end of the fishing neck body and terminates with an opening configured to receive a cable, and wherein the fishing neck body comprises a first recess and a second recess disposed along an interior wall of a first axial portion of the fishing neck body;

one or more pins disposed within the first recess of the first body portion and the second recess of the second body portion to couple the first body portion to the second body portion;

a collar configured to circumferentially surround a second axial portion of the fishing neck body, wherein the collar comprises a third recess configured to align with a corresponding groove on an exterior surface of the fishing neck body; and a biasing member configured to be disposed within the third recess and in contact with the corresponding groove to couple the collar to the fishing neck body and prevent the collar from axially translating with respect to the fishing neck body.

2. The system of claim 1, wherein the first recess and the second recess do not extend to the exterior surface of the fishing neck body.

3. The system of claim 1, wherein the one or more pins each have a length less than half of a height of both the first body portion and the second body portion.

4. The system of claim 1, wherein the one or more pins are one or more dowel pins.

5. The system of claim 1, wherein the collar is a threaded collar comprising a first threading that matches second threading on the exterior surface of the fishing neck body.

6. The system of claim 1, wherein the biasing member is a spring pin.

7. The system of claim 1, wherein the second axial portion generally overlaps with the first axial portion along a longitudinal axis of the fishing neck body.

8. The system of claim 1, wherein the one or more pins are threaded.

9. The system of claim 1, wherein the fishing neck body comprises an indentation that circumferentially surrounds the fishing neck body.

10. The system of claim 9, wherein the collar comprises a projection configured to couple to the indentation of the fishing neck body.

11. The system of claim 1, wherein an exterior surface of the collar is knurled.

12. The system of claim 1, wherein an outer diameter of the fishing neck body along a third body portion is configured to fit a fishing extension.

13. A fishing tool receiver assembly, comprising:

a fishing extension;

a cable;

a body of a fishing neck or a steel boot, wherein the body comprises a first body portion and a second body portion, wherein the first body portion and the second body portion are configured to be coupled along an interface that extends from an upstream end of the body to a downstream end of the body and terminates with an opening configured to receive the cable, wherein the first body portion comprises a first recess and the second body portion comprises a second recess, and wherein each of the first and second recesses are disposed along an interior wall of a first axial portion of the body;

one or more pins configured to be disposed within the first recess of the first body portion and the second recess of the second body portion to couple the first body portion to the second body portion;

a collar configured to circumferentially surround a second axial portion of the body, wherein the collar comprises a recess configured to align with a corresponding groove on an exterior surface of the body; and a biasing member configured to be disposed within the recess and in contact with the corresponding groove to couple the collar to the body and prevent the collar from axially translating with respect to the body.

14. The fishing tool receiver assembly of claim 13, wherein the one or more pins each have a length less than half of a height of both the first body portion and the second body portion.

15. The fishing tool receiver assembly of claim 13, wherein the first recess and the second recess do not extend to an exterior surface of the body.

16. The fishing tool receiver assembly of claim 13, wherein the body comprises an indentation that circumferentially surrounds the body.

17. The fishing tool receiver assembly of claim 16, wherein the collar comprises a projection configured to couple to the indentation of the body.

18. The fishing tool receiver assembly of claim 13, wherein the second axial portion generally overlaps with the first axial portion along a longitudinal axis of the body.

19. A method of assembling a fishing neck or steel boot around a cable, the method comprising:

positioning a first body portion and a second body portion around the cable, wherein both the first body portion and the second body portion comprise a first recess and a second recess, respectively, formed at an interface between the first body portion and the second body portion, and wherein the first body portion and the second body portion comprise an indentation that circumferentially surrounds an exterior surface of the first body portion and the second body portion;

coupling the first body portion to the second body portion by disposing pins within the first recess of the first body portion and the second recess of the second body portion;

positioning a collar circumferentially around an axial portion of the first body portion and the second body portion, wherein the collar comprises a collar recess; and aligning a biasing member with the collar recess and the indentation to couple the first body portion and the second body portion to the collar.

20. The method of claim 19, wherein the axial portion overlaps with the first recess and the second recess along a longitudinal axis of the first body portion and the second body portion.

* * * * *